US009481547B2

(12) United States Patent
Flynn et al.

(10) Patent No.: US 9,481,547 B2
(45) Date of Patent: Nov. 1, 2016

(54) ELEVATOR SYSTEM WITH DYNAMIC TRAFFIC PROFILE SOLUTIONS

(75) Inventors: Michael P. Flynn, Avon, CT (US); Dennis Hanvey, Leonardo, NJ (US); Allen Patenaude, Torrington, CT (US); Jannah A. Stanley, Portland, CT (US)

(73) Assignee: Otis Elevator Company, Farmington, CT (US)

( * ) Notice: Subject to any disclaimer, the term of this patent is extended or adjusted under 35 U.S.C. 154(b) by 451 days.

(21) Appl. No.: 14/342,838

(22) PCT Filed: Sep. 8, 2011

(86) PCT No.: PCT/US2011/050751

§ 371 (c)(1),
(2), (4) Date: Mar. 5, 2014

(87) PCT Pub. No.: WO2013/036225

PCT Pub. Date: Mar. 14, 2013

(65) Prior Publication Data

US 2014/0231177 A1 Aug. 21, 2014

(51) Int. Cl.

| | |
|---|---|
| ***B66B 1/16*** | (2006.01) |
| ***B66B 1/18*** | (2006.01) |
| ***B66B 1/24*** | (2006.01) |

(52) U.S. Cl.

CPC ..... *B66B 1/18* (2013.01); *B66B 1/2458* (2013.01); *B66B 2201/401* (2013.01); *B66B 2201/404* (2013.01); *B66B 2201/406* (2013.01)

(58) Field of Classification Search

CPC . B66B 1/18; B66B 1/2458; B66B 2201/401; B66B 2201/404; B66B 2201/406

USPC ..... 187/247, 380–389, 391, 392, 393

See application file for complete search history.

(56) References Cited

U.S. PATENT DOCUMENTS

| | | | | |
|---|---|---|---|---|
| 3,642,099 | A | 2/1972 | Yuminaka et al. | |
| 4,492,288 | A | 1/1985 | Schroder | |
| 4,838,384 | A | 6/1989 | Thangavelu | |
| 5,229,559 | A * | 7/1993 | Siikonen ..... | B66B 1/2408 187/382 |
| 5,243,155 | A | 9/1993 | Sirag, Jr. | |

(Continued)

FOREIGN PATENT DOCUMENTS

| | | |
|---|---|---|
| EP | 0739848 A2 | 10/1996 |
| JP | 58-151160 | 10/1983 |

(Continued)

OTHER PUBLICATIONS

International Search Report and Written Opinion of the International Searching Authority for International application No. PCT/US2011/050751 dated Apr. 12, 2012.

(Continued)

*Primary Examiner* — Anthony Salata
(74) *Attorney, Agent, or Firm* — Carlson, Gaskey & Olds

(57) ABSTRACT

An exemplary method of controlling an elevator system includes determining that a temporary heavy traffic condition exists that includes a plurality of passengers requiring elevator service from an originating floor in the building that is distinct from a lobby floor. At least one elevator car out of a plurality of elevator cars within the building is temporarily dedicated to carry the passengers from the originating floor. A peak travel scheduling strategy is temporarily used for controlling the dedicated elevator car or cars for a selected period of time.

18 Claims, 2 Drawing Sheets

(56) References Cited

U.S. PATENT DOCUMENTS

| | | | | |
|---|---|---|---|---|
| 5,260,526 | A * | 11/1993 | Sirag, Jr. | B66B 1/2408 187/382 |
| 5,274,202 | A * | 12/1993 | Kezer | B66B 1/2408 187/385 |
| 5,276,295 | A * | 1/1994 | Kameli | B66B 1/2408 187/383 |
| 5,511,634 | A * | 4/1996 | Bahjat | B66B 1/2458 187/383 |
| 5,544,059 | A * | 8/1996 | Hikita | B66B 1/2408 701/117 |
| 5,679,932 | A | 10/1997 | Kim | |
| 5,750,946 | A | 5/1998 | Thangavelu | |
| 5,969,304 | A | 10/1999 | Barker et al. | |
| 6,257,373 | B1 * | 7/2001 | Hikita | B66B 1/2458 187/387 |
| 6,401,874 | B2 * | 6/2002 | Siikonen | B66B 1/2458 187/382 |
| 6,672,431 | B2 | 1/2004 | Brand et al. | |
| 7,434,665 | B2 * | 10/2008 | Bahjat | B66B 1/20 187/247 |
| 7,735,611 | B2 * | 6/2010 | Tyni | B66B 1/20 187/386 |
| 7,921,968 | B2 * | 4/2011 | Stanley | B66B 1/20 187/383 |
| 7,975,808 | B2 * | 7/2011 | Smith | B66B 1/2458 187/247 |
| 8,960,373 | B2 * | 2/2015 | De Vincentis | B66B 1/2408 187/381 |
| 2006/0249336 | A1 | 11/2006 | Bahjat et al. | |
| 2007/0039785 | A1 | 2/2007 | Smith et al. | |
| 2009/0133967 | A1 | 5/2009 | Smith et al. | |

FOREIGN PATENT DOCUMENTS

| | | | |
|---|---|---|---|
| JP | 62-5870 | | 2/1987 |
| JP | H02215672 | A | 8/1990 |
| JP | 5139636 | | 6/1993 |
| JP | 09020468 | A | 1/1997 |
| JP | 09-202547 | | 8/1997 |
| JP | 2641747 | B2 | 8/1997 |
| JP | H09315707 | | 12/1997 |
| JP | 2007-31110 | | 2/2007 |
| JP | 2010195532 | A | 9/2010 |
| KR | 20090094827 | A | 9/2009 |

OTHER PUBLICATIONS

State Intellectual Property Office of People's Republic China, First Search, Application No. 201180073310.0, undated.

International Preliminary Report on Patentability for International application No. PCT/US2011/050751 dated Mar. 20, 2014.

* cited by examiner

ELEVATOR SYSTEM WITH DYNAMIC TRAFFIC PROFILE SOLUTIONS

BACKGROUND

Elevator systems are useful for carrying passengers between various levels within a building. In many situations there are special considerations that must be taken into account to provide efficient service to passengers. For example, many commercial buildings have a high traffic load in the morning hours when people are arriving for work. This is commonly referred to as an up-peak traffic condition because of the large amount of traffic traveling upward from a ground floor or lobby floor of the building. A variety of up-peak traffic scheduling strategies are known to improve elevator service during such times.

One limitation on known up-perk scheduling strategies is that they only address one type of situation. Additionally, up-peak scheduling strategies, for example, only work with the lobby floor as the departure floor and are only capable of handling large volumes of traffic going in an upward direction.

Other situations arise within different buildings and different settings that may occur on an irregular or sporadic basis. Known elevator systems are not capable of addressing the needs of such situations.

SUMMARY

An exemplary method of controlling an elevator system includes determining that a temporary heavy traffic condition exists that includes a plurality of passengers requiring elevator service from an originating floor in the building that is distinct from a lobby floor. At least one elevator car out of a plurality of elevator cars within the building is temporarily dedicated to carry the passengers from the originating floor. A peak travel scheduling strategy is temporarily used for controlling any dedicated elevator car for a selected period of time.

An exemplary elevator system includes a plurality of elevator cars situated within a building. A controller is configured to determine that a temporary heavy traffic condition exists that includes a plurality of passengers requiring elevator service from an originating floor in the building that is distinct from a lobby floor. The controller temporarily dedicates at least one of the elevator cars to carry the passengers from the originating floor. The controller is also configured to temporarily use a peak travel scheduling strategy for controlling any dedicated elevator car for a selected period of time.

The various features and advantages of this invention will become apparent to those skilled in the art from the following detailed description of an example embodiment. The drawings that accompany the detailed description can be briefly described as follows.

DETAILED DESCRIPTION

Figure 1:
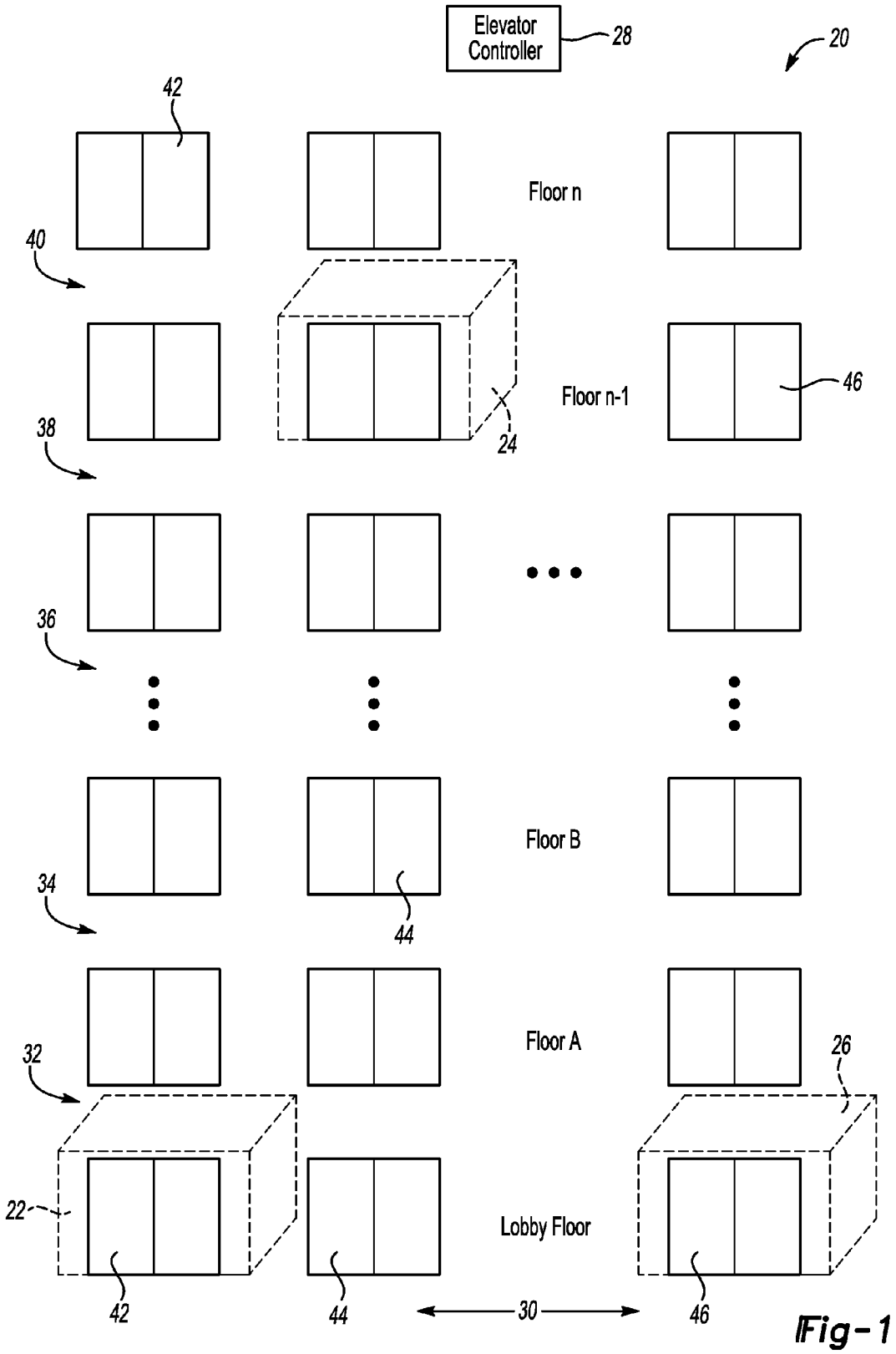
FIG. 1 schematically illustrates selected portions of an example elevator system designed according to an embodiment of this invention.

FIG. 1 schematically illustrates selected portions of an elevator system 20. A plurality of elevator cars 22, 24 and 26 are situated within a building for carrying passengers between different levels or floors within the building. Only three elevator cars 22, 24 and 26 are illustrated for discussion purposes. This invention is not limited to a particular number of elevator cars.

An elevator controller 28 controls operation of the elevator cars 22, 24 and 26 by assigning an operating mode to each car so that it serves passengers according to a predetermined strategy. For example, the elevator controller 28 may group cars for serving particular floors or sectors and may select different scheduling strategies for each of the cars. Although a single elevator controller 28 is schematically illustrated, more than one controller device may be used for these purposes. The example elevator controller 28 may be realized using an elevator group controller, for example. Alternatively, the example elevator controller 28 may be realized by having individual elevator controllers that communicate with each other or a central control for realizing the features and functionality of the discussed example.

As can be appreciated from FIG. 1, the elevator cars 22, 24 and 26 provide service to a plurality of floors within a building including a lobby floor 30, intermediate floors 32, 34, 36 and 38 and a highest floor 40. Each of the floors includes a landing where passengers have access to the corresponding elevator car. In the illustration, hoistway doors 42 are positioned at each landing serviced by the car 22, hoistway doors 44 are positioned at each landing serviced by the car 24 and hoistway doors 46 are positioned at each landing serviced by the car 26.

Under normal operating conditions, the elevator controller 28 uses any of a plurality of known elevator control, car assignment and scheduling strategies. The illustrated example also includes the ability to address particular or unusual traffic conditions in which there are a relatively large number of passengers that require elevator service from an originating floor that is distinct from the lobby floor 30. For example, temporary heavy traffic conditions may occur during a typical lunch hour in a building where a cafeteria is located on one of the intermediate floors. A relatively large number of passengers will require service from that building level to one or more other building levels so that they can return to work after lunch. Other heavy traffic conditions may occur because of a large number of people leaving a rooftop hotel restaurant, a top floor conference room or the location of a well-attended event such as a large wedding within a hotel, for example.

Figure 2:
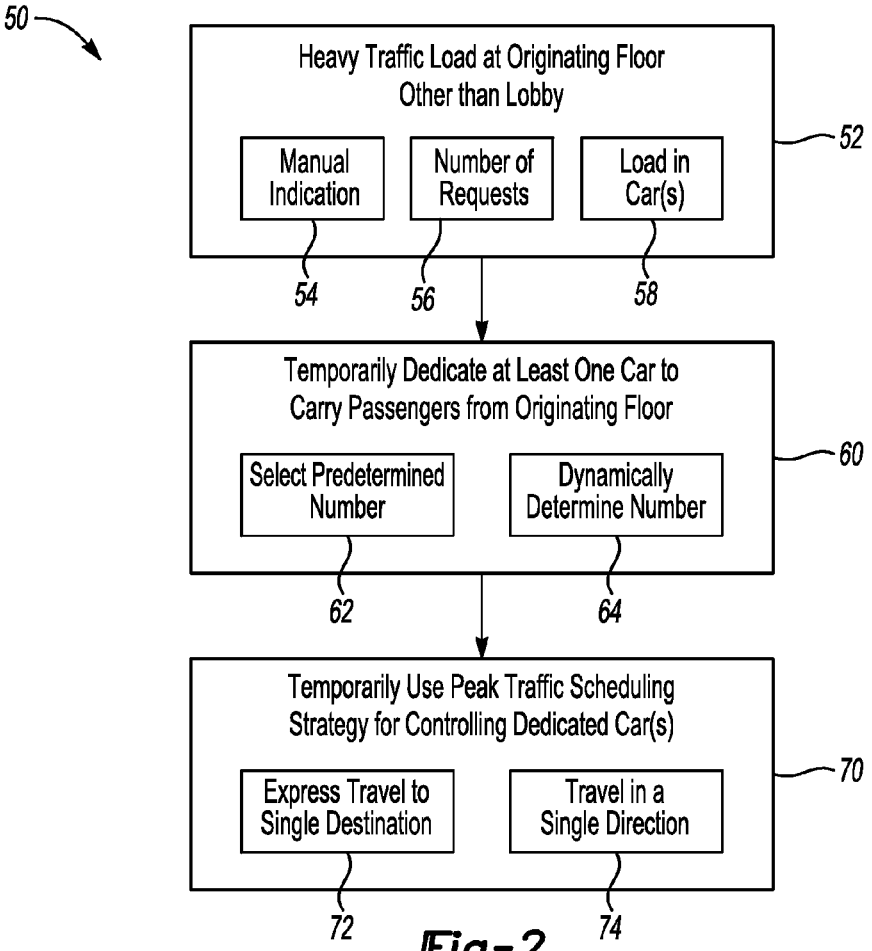
FIG. 2 is a flowchart diagram summarizing an example approach consistent with an embodiment of this invention.

FIG. 2 includes a flowchart diagram 50 summarizing an example approach for dynamically addressing heavy traffic conditions that include passengers requiring service from an originating floor other than the lobby floor 30. A determination is made at 52, by the controller 28 for example, whether a heavy traffic load at an originating floor other than the lobby floor 30, exists. According to the illustrated example, this determination can be made in one of several ways. At 54 a determination is made based upon a manual indication that is provided to the controller 28 by an authorized individual. A building manager, for example, in one embodiment has the ability to provide an indication to the elevator controller 28 that a particular traffic condition needs to be addressed. The building manager will know, for example, scheduled events within the building that will involve a heavy traffic condition such as when a large conference is concluding or when a special event on a particular floor of the building is over.

Another way in which the determination whether a heavy traffic load exists is made in the illustrated example includes determining whether a number of requests for elevator service from a particular floor indicates a heavy traffic condition. This is illustrated at 56 in FIG. 2. When the number of requests from a particular floor exceeds a predetermined threshold within a selected amount of time, that can serve as an indication of a heavy traffic load condition in which a large number of individuals are requesting elevator service from that floor. Another technique includes checking a frequency at which requests are made from a particular floor.

Another way of determining whether there is a heavy traffic load at an originating floor other than the lobby according to the example of FIG. 2 includes determining whether a load in one or more elevator cars indicates a heavy traffic condition. This is illustrated at 58 in FIG. 2. For example, if more than one elevator car is heavily loaded at approximately the same time departing from the same floor that can be an indication of a large number of people requiring service from that floor.

The elevator controller 28 uses one or more of the example indications for making the determination at 52. When there is a heavy traffic load, the controller 28 temporarily dedicates at least one of the elevator cars 22, 24 or 26 to carry passengers from the originating floor. This is shown at 60 in FIG. 2. In the illustrated example, the number of cars dedicated to provide service from the originating floor, which is distinct from the lobby floor 30, is either a predetermined number as shown at 62 or a dynamically determined number as shown at 64. In some examples, the number of elevator cars available within a building will place limits on how many cars can be dedicated to address a temporary heavy traffic situations. For such systems, selecting a predetermined number at 62 will allow for addressing the heavy traffic load and still maintaining an adequate number of elevator cars available for providing other service within the building. Other elevator systems will have enough elevator cars available that the elevator controller 28 may select a different number of cars depending on the particular traffic load condition. Given this description, those skilled in the art will realize which way of selecting the number of elevator cars to address the heavy traffic load will meet the needs of their particular situation.

Once at least one elevator car has been temporarily dedicated exclusively to serving passengers traveling from the originating floor, the controller 28 temporarily uses at least one peak traffic scheduling strategy for controlling the dedicated car or cars. This is shown at 70 in FIG. 2. One example scheduling strategy utilized at 72 includes providing express travel to a single destination. Express travel in this example allows an elevator car to travel between the originating floor and a single destination without any intermediate stops in either direction. For example, it may be that the heavy traffic load includes a large number of passengers (or even all of the passengers) requiring service from the originating floor to the same destination floor. The scheduling strategy in such a situation can include express travel to that single destination. This strategy is also useful at times when a large number of people are traveling from an originating floor and exiting the building. In such a situation, the lobby or ground floor 30 may be the single destination.

In other examples, the express travel scheduling strategy includes the ability to bring passengers back to the originating floor. Some examples will allow a limited number of stops during the elevator car return trip to the originating floor but those are kept to a minimum to maintain the benefits of having temporary express travel service to address the need to carry a large number of passengers from the originating floor.

Other scenarios will involve a large number of passengers leaving an originating floor but traveling to multiple locations within the building. For such situations, it may be useful to have at least one car scheduled to provide express travel to a single destination but have one or more other cars scheduled with more flexibility so that passengers arrive at their intended destinations.

Another scheduling strategy is shown at 74 which involves controlling an elevator car to travel in a single direction from the originating floor. For situations in which a cafeteria floor, for example, is located near a middle of the height of a building, many individuals may travel upward after lunch while others will travel downward. One example includes scheduling at least one of the dedicated elevator cars to always travel in an upward direction and then return to the originating floor to pick up more passengers. Another one of the dedicated elevator cars may be scheduled to only travel in a downward direction from the originating floor and then return to pick up more passengers.

Some examples include using one scheduling strategy for one of the dedicated elevator cars and a second, different scheduling strategy for another one of the dedicated elevator cars. When passengers leaving the originating floor desire to be carried to multiple destinations, it may be useful to assign different scheduling strategies to different ones of the dedicated elevator cars that are addressing the heavy traffic condition at that originating floor. A split group operation approach may be used, for example, to provide service to passengers heading to different destinations potentially in different directions from the originating floor.

In one example, the scheduling strategy is analogous to an up-peak scheduling strategy with the originating floor treated as a virtual lobby and the lobby floor 30 treated as any other destination floor. One such scheduling strategy also substitutes downward travel for upward travel in the scheduling algorithm to provide service in a downward direction from the virtual lobby.

After a selected amount of time, the elevator cars can be returned to normal service so that they are no longer dedicated to the particular needs and scheduling strategy used for addressing the temporary heavy traffic load. In one example, a predetermined amount of time is used for the traffic scheduling strategy. In another example, a controller 28 obtains information that the heavy traffic load condition has subsided and returns the dedicated elevator cars back to normal service eligibility.

One example includes changing the status of one or more of the elevator cars during the temporary heavy traffic load. For example, one car may be an express service car during a first portion of the time during which peak travel scheduling strategy is used. That car is returned to a normal scheduling strategy while a different car is substituted in as the express service car for a second portion of the time during which peak travel scheduling is used.

Figure 3:
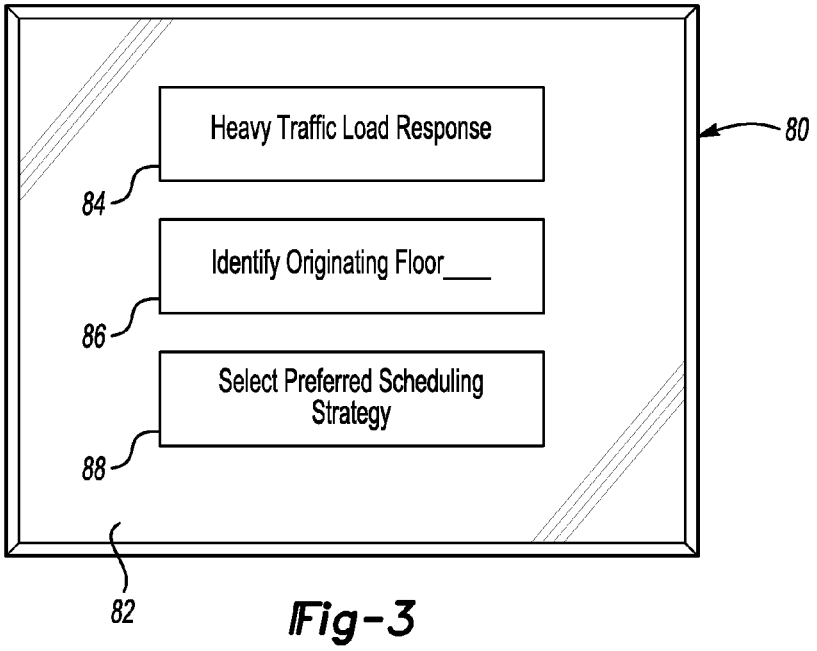
FIG. 3 schematically illustrates a user interface that is useful with an example embodiment of this invention.

FIG. 3 schematically illustrates an interface device 80 that allows an individual such as a building manager to communicate with the elevator controller 28 to request a response to a heavy traffic load. This example includes a touch screen display 82 that includes menu options that may be selected to provide the desired information to the elevator controller 28. In this example, a selection at 84 allows an authorized individual to provide an indication that a heavy traffic load response is required. At 86, an input function allows for an individual to identify the originating floor from which the passengers will need to be carried. A menu option at 88 allows for selecting a preferred scheduling strategy such as express operation, single direction operation, sectoring or split group operation according to the preferences of the authorized individual, for example.

The interface device 80 may be a handheld wireless communication device or may be integrated into a building communication network, for example.

The disclosed example allows for addressing particular traffic needs within a building to dynamically provide peak travel service from any of a plurality of floors within a building. With the disclosed example it is possible to address a variety of elevator traffic situations to move a large number of passengers within a relatively short period of time to provide enhanced elevator service.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling an elevator system that includes a plurality of elevator cars within a building, comprising the steps of:

determining that a temporary heavy traffic condition exists that includes a plurality of passengers requiring elevator service from an originating floor in the building that is distinct from a lobby floor;

temporarily dedicating a plurality of elevator cars to carry the passengers from the originating floor; and temporarily using a peak travel scheduling strategy for controlling the plurality of elevator cars for a selected period of time including using a first scheduling strategy for controlling a first one of the elevator cars; and using a second, different scheduling strategy for controlling a second one of the elevator cars.

2. The method of claim 1, comprising determining that the temporary heavy traffic condition exists responsive to an indication from an authorized individual.

3. The method of claim 2, wherein the authorized individual is a building manager.

4. The method of claim 1, comprising determining that the temporary heavy traffic condition exists responsive to a number of requests for elevator service registered at the originating floor exceeding a predetermined threshold.

5. The method of claim 1, comprising determining that the temporary heavy traffic condition exists responsive to a load in at least one elevator car departing from the originating floor exceeding a predetermined threshold.

6. The method of claim 1, wherein the first scheduling strategy comprises at least one of using the first elevator car to carry passengers in only a first direction from the originating floor; or using the first elevator car to carry passengers to only a first destination floor from the originating floor.

7. The method of claim 6, wherein the second scheduling strategy comprises at least one of using the second elevator car to carry passengers in only a second direction from the originating floor, the second direction being different than the first direction; or using the second elevator car to carry passengers to only a second destination floor from the originating floor, the second destination floor being different than the first destination floor.

8. The method of claim 1, comprising determining a number of elevator cars to control using the peak travel scheduling strategy based on information regarding the temporary heavy traffic condition.

9. An elevator system, comprising:

a plurality of elevator cars situated within a building; and a controller configured to determine that a temporary heavy traffic condition exists that includes a plurality of passengers requiring elevator service from an originating floor in the building that is distinct from a lobby floor;

temporarily dedicate more than one of the plurality of the elevator cars to carry the passengers from the originating floor; and temporarily use a peak travel scheduling strategy for controlling the more than one of the plurality of the elevator cars for a selected period of time including using a first scheduling strategy for controlling a first one of the elevator cars; and using a second, different scheduling strategy for controlling a second one of the elevator cars.

10. The elevator system of claim 9, wherein the controller is configured to determine that the temporary heavy traffic condition exists responsive to an indication from an authorized individual.

11. The elevator system of claim 10, wherein the authorized individual is a building manager.

12. The elevator system of claim 9, wherein the controller is configured to determine that the temporary heavy traffic condition exists responsive to a number of requests for elevator service registered at the originating floor exceeding a predetermined threshold.

13. The elevator system of claim 9, wherein the controller is configured to determine that the temporary heavy traffic condition exists responsive to a load in at least one elevator car departing from the originating floor exceeding a predetermined threshold.

14. The elevator system of claim 9, wherein the first scheduling strategy comprises at least one of using the first elevator car to carry passengers in only a first direction from the originating floor; or using the first elevator car to carry passengers to only a first destination floor from the originating floor.

15. The elevator system of claim 14, wherein the second scheduling strategy comprises at least one of using the second elevator car to carry passengers in only a second direction from the originating floor, the second direction being different than the first direction; or using the second elevator car to carry passengers to only a second destination floor from the originating floor, the second destination floor being different than the first destination floor.

16. The elevator system of claim 9, wherein the controller is configured to determine a number of the elevator cars to control using the peak travel scheduling strategy based on information regarding the temporary heavy traffic condition.

17. The elevator system of claim 9, wherein the first scheduling strategy comprises allowing the first elevator car to only stop at the originating floor and a first destination floor; and the second scheduling strategy comprises allowing the second elevator car to stop at the originating floor and more than one destination floor.

18. The method of claim 9, wherein the first scheduling strategy comprises allowing the first elevator car to only stop at the originating floor and a first destination floor; and the second scheduling strategy comprises allowing the second elevator car to stop at the originating floor and more than one destination floor.

* * * * *